US008905516B2

(12) United States Patent
Inoue

(10) Patent No.: US 8,905,516 B2
(45) Date of Patent: Dec. 9, 2014

(54) NOZZLE SURFACE CLEANING APPARATUS AND IMAGE RECORDING APPARATUS

(71) Applicant: FUJIFILM Corporation, Tokyo (JP)

(72) Inventor: Hiroshi Inoue, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 8 days.

(21) Appl. No.: 13/731,657

(22) Filed: Dec. 31, 2012

(65) Prior Publication Data

US 2013/0176362 A1 Jul. 11, 2013

(30) Foreign Application Priority Data

Jan. 6, 2012 (JP) ..... 2012-001420

(51) Int. Cl.
*B41J 2/165* (2006.01)

(52) U.S. Cl.
CPC ..... *B41J 2/16535* (2013.01); *B41J 2/16523* (2013.01); *B41J 2/16532* (2013.01); *B41J 2/16552* (2013.01); *B41J 2/16544* (2013.01)
USPC ..... 347/33; 347/22; 347/31

(58) Field of Classification Search
CPC ..... B41J 2/16552; B41J 2/16535
See application file for complete search history.

(56) References Cited

U.S. PATENT DOCUMENTS

2004/0218002 A1 11/2004 Nakamura
2006/0238563 A1 10/2006 Nakamura
2010/0079539 A1 4/2010 Inoue
2010/0214355 A1 8/2010 Inoue
2010/0245466 A1 9/2010 Inoue
2010/0309251 A1* 12/2010 Cramm et al. ..... 347/33
2011/0074870 A1* 3/2011 Maida ..... 347/28
2012/0236071 A1 9/2012 Inoue

FOREIGN PATENT DOCUMENTS

EP 0945270 A2 9/1999
JP 2003-265992 A 9/2003
JP 2004-195908 A 7/2004
JP 2008-137266 A 6/2008

(Continued)

OTHER PUBLICATIONS

An Office Action; "Notification of Reasons for Rejection," issued by the Japanese Patent Office on Dec. 10, 2013, which corresponds to Japanese Patent Application No. 2012-001420 and is related to U.S. Appl. No. 13/731,657; with partial translation.

(Continued)

*Primary Examiner* — Justin Seo
(74) *Attorney, Agent, or Firm* — Studebaker & Brackett PC

(57) ABSTRACT

According to the present invention, firstly, since the cleaning liquid is deposited onto the nozzle surface by the nozzle surface cleaning liquid deposition device, then it is possible to raise the dissolving effect, which is a chemical effect of dissolving adhering material which is adhering to the nozzle surface. Consequently, it is possible to remove the adhering material readily by subsequently wiping the nozzle surface with the wiping member, and hence the physical effects can also be improved. Furthermore, since the cleaning liquid is deposited so as to wet the wiping member, then it is possible to suppress the drawing out of liquid from the nozzles due to the absorbing characteristics of the wiping member, and therefore ejection defects due to solidification of drawn out liquid can be prevented. Consequently, it is possible to improve ejection stability of the droplet ejection head.

19 Claims, 7 Drawing Sheets

(56) References Cited

FOREIGN PATENT DOCUMENTS

| | | | |
|---|---|---|---|
| JP | 2010-082856 | A | 4/2010 |
| JP | 2010-188707 | A | 9/2010 |
| JP | 2010-234666 | A | 10/2010 |
| JP | 2010-260211 | A | 11/2010 |
| JP | 2011-194601 | A | 10/2011 |
| WO | 2011/040146 | A1 | 4/2011 |

OTHER PUBLICATIONS

The extended European Search Report issued on Mar. 21, 2013, which corresponds to EP Application No. 13150111.6-1701 and is related to U.S. Appl. No. 13/731,657.

* cited by examiner

NOZZLE SURFACE CLEANING APPARATUS AND IMAGE RECORDING APPARATUS

BACKGROUND OF THE INVENTION

1. Field of the Invention

The present invention relates to a nozzle surface cleaning apparatus and an image recording apparatus, and more particularly, to a nozzle surface cleaning apparatus which wipes a nozzle surface by abutting and pressing a traveling wiping member against the nozzle surface, and to an image recording apparatus.

2. Description of the Related Art

With use, foreign matter of various types, such as ink residue, paper dust, or the like, adheres to the nozzle surface of an inkjet head which is used in an image recording apparatus, for example, an inkjet recording apparatus. If foreign matter adheres to the nozzle surface, ink droplets ejected from the nozzles are affected, variation occurs in the ejection direction of the ink droplets, it becomes difficult to deposit the ink droplets at the prescribed positions on the recording medium, and this becomes a cause of decline in the image quality. Therefore, in an inkjet recording apparatus, it is important to remove foreign matter periodically by means of a maintenance method, such as wiping, or the like.

For example, Japanese Patent Application Publication No. 2004-195908 describes controlling a wiping sheet which wipes a droplet ejection head, by a winding motor which forms a conveyance mechanism, and wiping the droplet ejection head with the wiping sheet after supplying cleaning liquid to the wiping sheet by a cleaning liquid ejection head. Furthermore, Japanese Patent Application Publication No. 2010-188707 describes a cleaning apparatus having a cleaning liquid supply device which supplies cleaning liquid by a non-contact method onto a nozzle surface of a droplet ejection head, and a wiping device which wipes a nozzle surface.

However, the cleaning apparatus which is described in Japanese Patent Application Publication No. 2004-195908 has a short contact time between the cleaning liquid and the adhering material on the ejection surface of the droplet ejection head, and therefore has not been able to display sufficient cleaning effects by the cleaning liquid. Therefore, it has been necessary to use physical force to remove the adhering material, by applying a high pressure to the droplet ejection head or increasing the relative speed differential between the droplet ejection head and the wiping sheet. However, if excessive force is applied to the ejection surface of a droplet ejection head, then there is a problem in that decline in the properties of the lyophobic film formed on the ejection surface becomes greater.

Moreover, the method of depositing cleaning liquid onto the nozzle surface of the liquid ejection head described in Japanese Patent Application Publication No. 2010-188707 induces ink to be drawn out from the nozzles due to contact with the meniscus in the nozzles, when the nozzle surface is wiped with a wiping member. For instance, if a rubber blade made or silicone, or the like, is used for the wiping member, then drawing out of ink from the nozzles is observed when the relative speed differential becomes large. Moreover, if cloth having fine fibers is used as a wiping member in order to improve the wiping properties, then the drawing out of ink becomes greater due to the absorption characteristics of the wiping member. The ink which is drawn out dries and solidifies, and is pushed inside the nozzle orifices during the next wiping action, thus creating an adverse effect on the directionality of the ejection.

SUMMARY OF THE INVENTION

The present invention was devised in view of circumstances such as these, an object thereof being to provide a nozzle surface cleaning apparatus and an image recording apparatus which sufficiently raises the dissolving effects of the cleaning liquid, as well as suppressing the drawing out of ink onto the nozzle surface after wiping, and which can thereby suppress deterioration of the directionality of ejection.

In order to achieve the above object, the present invention provides a nozzle surface cleaning apparatus which cleans a nozzle surface of a droplet ejection head, including: a nozzle surface cleaning liquid deposition device which deposits cleaning liquid onto the nozzle surface of the droplet ejection head; a wiping member travel device which causes a wiping member having absorbing characteristics to travel; a wiping member cleaning liquid deposition device which deposits cleaning liquid onto the wiping member; and a pressing device which presses and abuts the wiping member on which the cleaning liquid has been deposited, against the nozzle surface on which the cleaning liquid has been deposited by the nozzle surface cleaning liquid deposition device, and wipes the nozzle surface with the wiping member.

According to the present invention, firstly, since the cleaning liquid is deposited onto the nozzle surface by the nozzle surface cleaning liquid deposition device, then it is possible to raise the dissolving effect, which is a chemical effect of dissolving adhering material which is adhering to the nozzle surface. Consequently, it is possible to remove the adhering material readily by subsequently wiping the nozzle surface with the wiping member, and hence the physical effects can also be improved. Furthermore, since the cleaning liquid is deposited so as to wet the wiping member, then it is possible to suppress the drawing out of liquid from the nozzles due to the absorbing characteristics of the wiping member, and therefore ejection defects due to solidification of drawn out liquid can be prevented. Consequently, it is possible to improve ejection stability of the droplet ejection head.

It is preferable that the nozzle surface cleaning apparatus according to further aspect of the present invention further includes a first flow channel for supplying the cleaning liquid to the nozzle surface cleaning liquid deposition device; a second flow channel for supplying the cleaning liquid to the wiping member cleaning liquid deposition device; a common flow channel for supplying the cleaning liquid to the first flow channel and the second flow channel; and a switching device which can switch the cleaning liquid supplied from the common flow channel, to the first flow channel or the second flow channel.

According to the nozzle surface cleaning apparatus relating to the further aspect of the present invention, switching of the cleaning liquid supplied from the common flow channel to the nozzle surface cleaning liquid deposition device or the wiping member cleaning liquid deposition device is carried out by the switching device, and therefore it is possible to simplify the apparatus.

In the nozzle surface cleaning apparatus according to further aspect of the present invention, it is preferable that the switching device switches from the second flow channel to the first flow channel, when the nozzle surface of the droplet ejection head reaches a position of the nozzle surface cleaning liquid deposition device.

According to the nozzle surface cleaning apparatus relating to the further aspect of the present invention, when the nozzle surface is situated at the position of the nozzle surface cleaning liquid deposition device, the switching device is switched and cleaning liquid is supplied to the nozzle surface cleaning liquid deposition device. Therefore, it is possible to deposit cleaning liquid on the wiping member up to that time. Consequently, the wiping member can be wetted by the time that the nozzle surface reaches the pressing device.

In the nozzle surface cleaning apparatus according to further aspect of the present invention, it is preferable that the wiping member travel device includes a rewind and fast-forward device for rewinding and fast-forwarding the wiping member.

According to the nozzle surface cleaning apparatus relating to the further aspect of the present invention, since the wiping member travel device includes a rewind and fast-forward device, then by depositing cleaning liquid onto a wiping member having a length required to clean the nozzle surface and then rewinding the wiping member, it is possible to reduce the space required for holding the wiping member. Furthermore, by fast-forwarding the wiping member, it is possible to speed up the application of cleaning liquid onto the wiping member.

The nozzle surface cleaning apparatus according to another aspect of the present invention preferably includes: a first flow channel for supplying the cleaning liquid to the nozzle surface cleaning liquid deposition device; a second flow channel for supplying the cleaning liquid to the wiping member cleaning liquid deposition device; and a common flow channel for supplying the cleaning liquid to the first flow channel and the second flow channel, the second flow channel being provided with a flow channel resistance member.

According to the nozzle surface cleaning apparatus relating to the another aspect of the present invention, the flow rate of the cleaning liquid is adjusted by providing a flow channel resistance member in the second flow channel for supplying cleaning liquid to the wiping member cleaning liquid deposition device. Consequently, since the amount of wetting of the wiping member can be adjusted, then it is possible to supply cleaning liquid to both the nozzle surface cleaning liquid deposition device and the wiping member cleaning liquid deposition device. Consequently, there is no need to deposit cleaning liquid over the whole of the wiping member which is used for cleaning, before moving the droplet ejection head, and hence the apparatus can be made compact in size.

The nozzle surface cleaning apparatus according to another aspect of the present invention preferably includes a squeezing device which removes excess cleaning liquid from the wiping member on which the cleaning liquid has been deposited.

According to the nozzle surface cleaning apparatus relating to the another aspect of the present invention, since it is possible to remove excess cleaning liquid of the cleaning liquid applied to the wiping member, then drawing out of the liquid is prevented, and wiping of the nozzle surface can be carried out without cleaning liquid remaining on the nozzle surface. Moreover, it is also possible to suppress dripping of liquid from the wiping member.

Preferably, the nozzle surface cleaning apparatus according to another aspect of the present invention further includes a tank which stores cleaning liquid, the tank is provided above the nozzle surface cleaning liquid deposition device and the wiping member cleaning liquid deposition device, in a vertical direction, and supply of the cleaning liquid to the nozzle surface cleaning liquid deposition device and the wiping member cleaning liquid deposition device is performed by a liquid head differential.

According to the nozzle surface cleaning apparatus relating to the another aspect of the present invention, the supply of the cleaning liquid can be performed by a liquid head differential without using a pump, and therefore it is possible to prevent non-uniformities in the deposition of cleaning liquid due to pulsation of a pump, or the like.

In order to achieve the above object, the present invention provides an image recording apparatus, including: a conveyance device which conveys a recording medium; a droplet ejection head which records an image by ejecting liquid droplets onto the recording medium which is conveyed by the conveyance device; and the above described nozzle surface cleaning apparatus which cleans the nozzle surface of the droplet ejection head.

According to the present invention, since a nozzle surface cleaning apparatus is provided, then ejection stability can be raised.

In the image recording apparatus according to another aspect of the present invention, it is preferable that the droplet ejection head is provided in plurality in a conveyance path of the recording medium, and the nozzle surface cleaning apparatus is provided for each of the droplet ejection heads.

The image recording apparatus relating to the another aspect of the present invention includes a nozzle surface cleaning apparatus for each droplet ejection head, and therefore it is possible appropriately to wipe each of the droplet ejection heads.

According to the nozzle surface cleaning apparatus and the image recording apparatus of the present invention, since a nozzle surface cleaning liquid deposition device which deposits cleaning liquid on the nozzle surface and a wiping member cleaning liquid deposition device which deposits cleaning liquid on the wiping member are provided, then it is possible to improve the chemical effect of dissolving the adhering material by cleaning liquid, and since the adhering material is dissolved, then the physical effect of wiping by the wiping member can be improved. Moreover, since the drawing out of liquid by the wiping member can be prevented, then it is possible to stabilize the ejection directionality of the droplets.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Below, an inkjet recording apparatus is described as one example of an image recording apparatus, but the present invention is not limited to this.

[First Embodiment]

<Composition of Inkjet Recording Apparatus>

Figure 1:
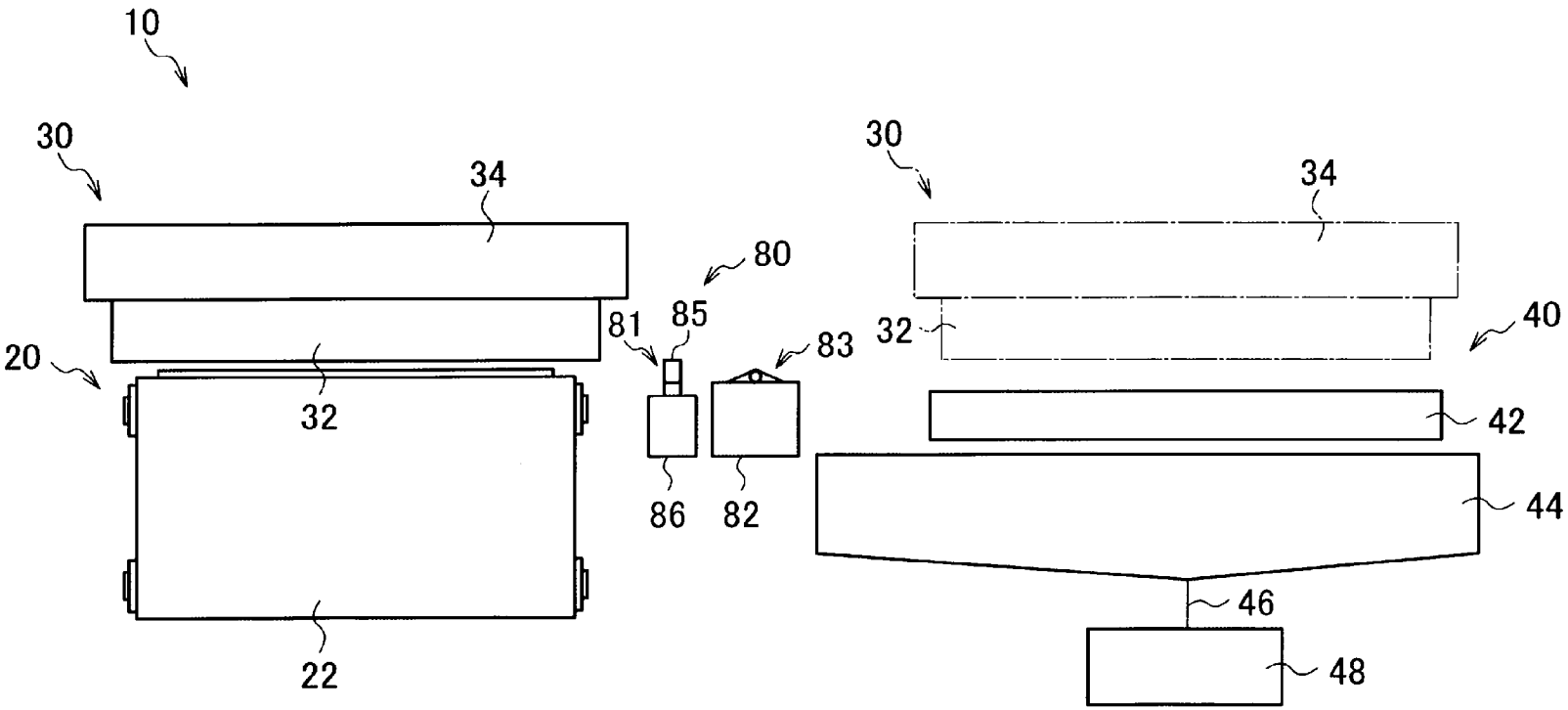
FIG. 1 is a front view diagram showing the composition of the principal part of an inkjet recording apparatus.
Figure 2:
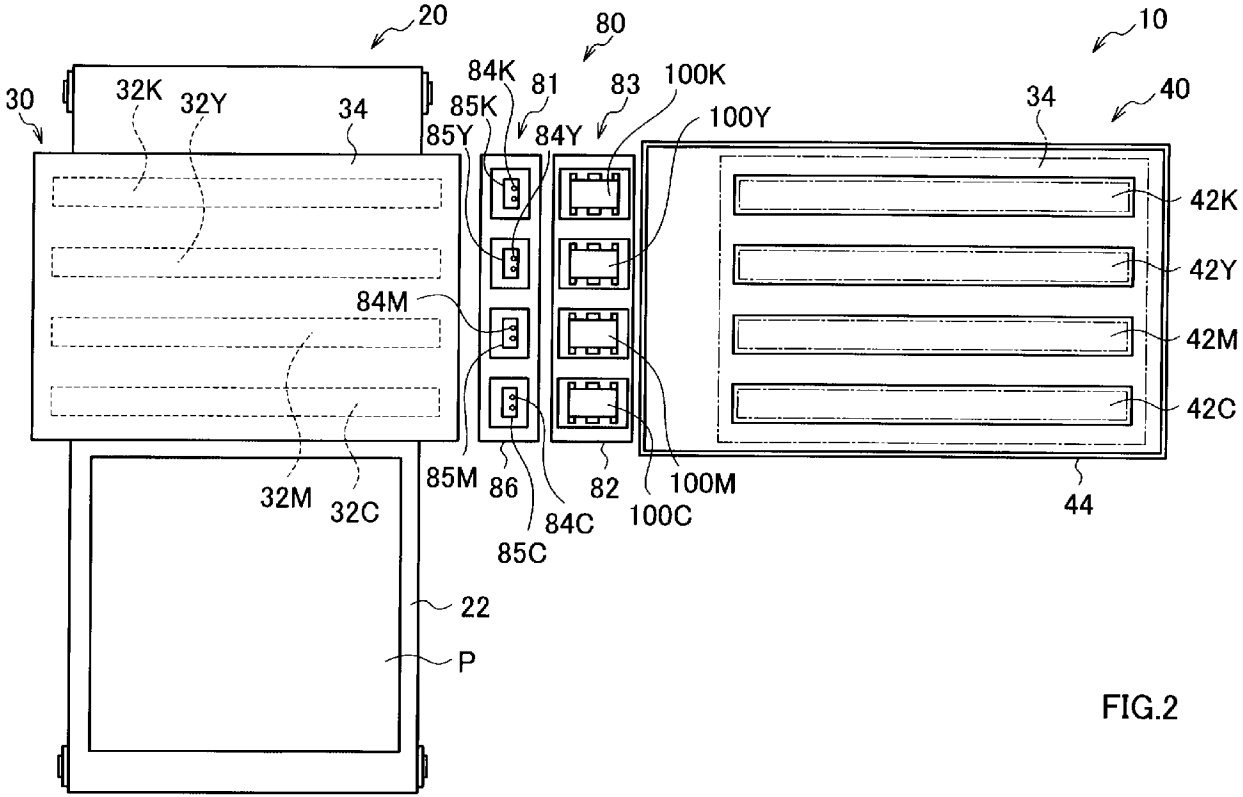
FIG. 2 is a plan diagram showing the composition of the principal part of an inkjet recording apparatus.
Figure 3:
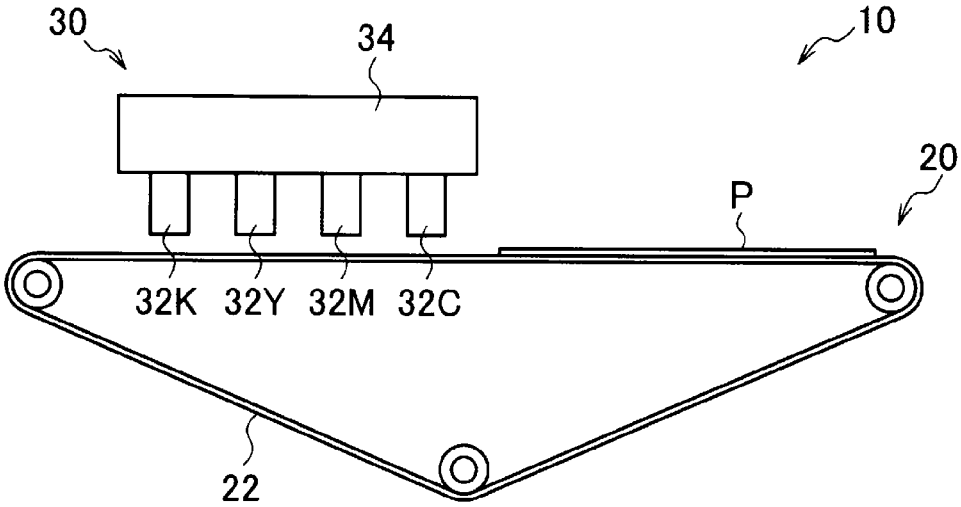
FIG. 3 is a side view diagram showing the composition of the principal part of an inkjet recording apparatus.

FIG. 1 to FIG. 3 are respectively a front view diagram, a plan diagram and a side view diagram showing a composition of the principal part of an inkjet recording apparatus relating to the present embodiment.

As shown in FIG. 1 to FIG. 3, this inkjet recording apparatus 10 is a single-pass type of line printer, which is principally constituted by a paper conveyance mechanism 20 for conveying paper (cut sheet paper) P serving as a recording medium, a head unit 30 which ejects ink droplets of respective colors of cyan (C), magenta (M), yellow (Y) and black (K) toward paper P which is conveyed by the paper conveyance mechanism 20, a maintenance unit 40 which carries out maintenance of the respective heads installed on the head unit 30, and a nozzle surface cleaning unit 80 which cleans the nozzle surfaces of the respective heads installed on the head unit 30.

The paper conveyance mechanism 20 is constituted by a belt conveyance mechanism and conveys the paper P horizontally by suctioning the paper P on a traveling belt 22.

The head unit 30 is principally constituted by a head 32C which ejects cyan ink droplets, a head 32M which ejects magenta ink droplets, a head 32Y which ejects yellow ink droplets, a head 32K which ejects black ink droplets, a head supporting frame 34 on which the heads 32C, 32M, 32Y, 32K are installed, and a head supporting frame movement mechanism (not illustrated) which moves the head supporting frame 34.

The heads (inkjet heads) 32C, 32M, 32Y, 32K are constituted by line heads which correspond to the maximum width of the paper P which is the object of printing. The heads 32C, 32M, 32Y, 32K each have the same composition, and are therefore referred to as the head 32 or heads 32 below, unless a specific head is to be distinguished.

The heads 32 (32C, 32M, 32Y, 32K) are formed in a rectangular block shape, and nozzle surfaces 33 (33C, 33M, 33Y, 33K) are formed in the bottom portion of each head.

Figure 4:
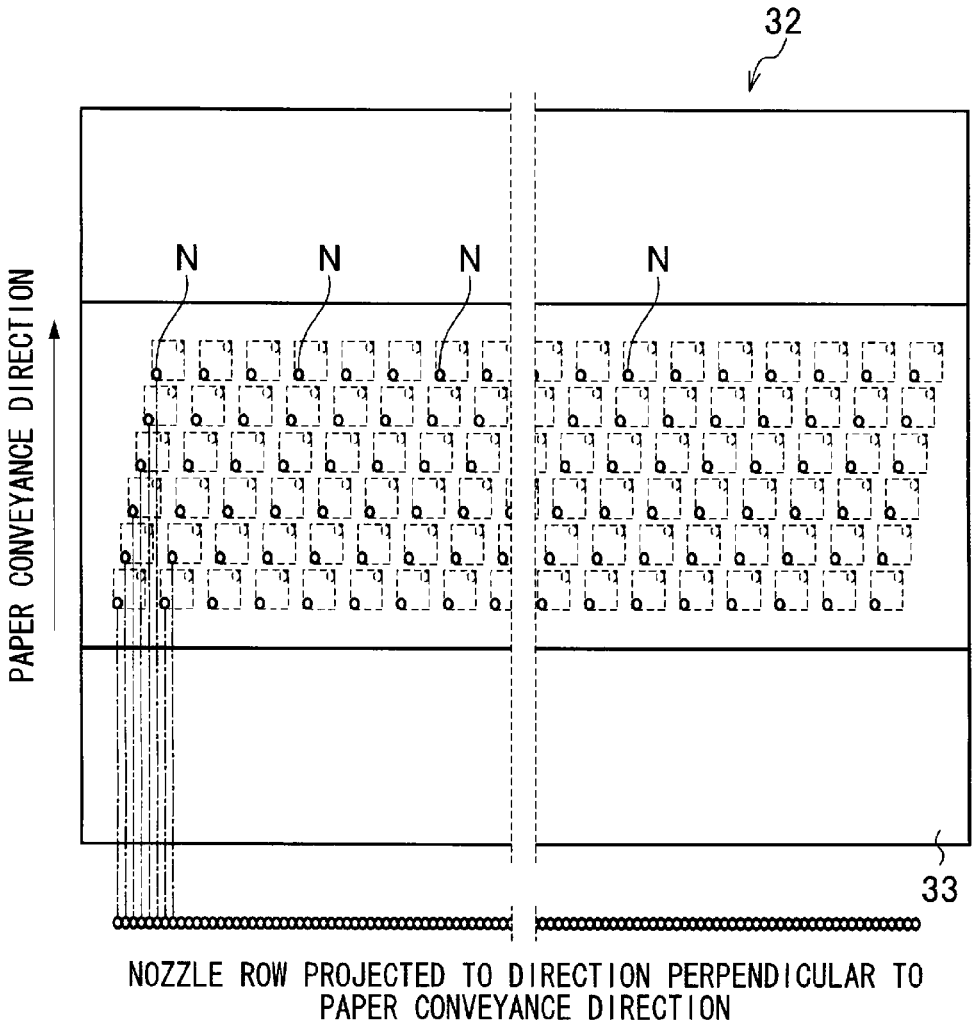
FIG. 4 is a plan view perspective diagram of a nozzle surface of a head.

FIG. 4 is a plan view perspective diagram of a nozzle surface of a head.

The nozzle surface 33 is formed in a long shape, and nozzle rows are formed in the lengthwise direction thereof. The heads 32 according to the present embodiment are each composed by a so-called matrix head, in which nozzles N are arranged in a two-dimensional matrix configuration. In a matrix head, it is possible to reduce the effective pitch between nozzles N when projected in the lengthwise direction of the head 32, and a high-density arrangement of the nozzles N can be achieved.

Furthermore, the head 32 according to the present embodiment ejects droplets of ink from nozzles N by a so-called piezo jet system. The nozzles N are respectively connected to pressure chambers, and a droplet of ink is ejected from a nozzle N by causing a wall of the pressure chamber to vibrate by a piezo element. The ink ejection method is not limited to this and may also adopt a composition which performs ejection by a thermal method.

The head supporting frame 34 includes a head installation section (not illustrated) for installing the heads 32. The heads 32 are installed detachably in this head installation section.

The heads 32 installed on the head supporting frame 34 are arranged perpendicularly with respect to the direction of conveyance of the paper P. Furthermore, the heads 32 are also arranged at a uniform interval apart in a prescribed order in the conveyance direction of the paper P (in the present example, the heads 32 are arranged in the order: cyan, magenta, yellow and black).

Furthermore, the head installation section is provided so as to be raisable and lowerable on the head supporting frame 34, and is raised and lowered by an elevator mechanism, which is not illustrated. The heads 32 which are installed on the head installation section are raised and lowered perpendicularly with respect to the conveyance surface of the paper P.

The head supporting frame movement mechanism causes the head supporting frame 34 to slide horizontally in a direction which is perpendicular to the direction of conveyance of the paper P, at a position above the paper conveyance mechanism 20.

The head supporting frame movement mechanism is, for example, constituted by a ceiling frame which is disposed horizontally over the paper conveyance mechanism 20, guide rails provided on the ceiling frame, a traveling body which slides over the guide rails, and a drive device which moves this traveling body along the guide rails (for example, a screw feed mechanism, or the like). The head supporting frame 34 is installed on the traveling body and slides horizontally.

The head supporting frame 34 is driven by this head supporting frame movement mechanism, and is provided movably between a prescribed "image recording position" and a "maintenance position".

The head supporting frame 34 is arranged over the paper conveyance mechanism 20 when positioned at the image recording position. By this means, it is possible to carry out printing onto the paper P which has been conveyed by the paper conveyance mechanism 20.

On the other hand, when the head supporting frame 34 is positioned at the maintenance position, then it is disposed at the position where the maintenance unit 40 is disposed.

Caps 42 (42C, 42M, 42Y, 42K) which cover the nozzle surfaces 33 of the heads 32 are provided in the maintenance unit 40. When the apparatus is halted for a long period of time, for example, the heads 32 are moved to the arrangement position (maintenance position) of this maintenance unit 40 and the nozzle surfaces 33 are covered with the caps 42. By this means, ejection failure due to drying is prevented.

A pressurizing and suctioning mechanism (not illustrated) for pressurizing and suctioning the interior of the nozzles and a cleaning liquid supply mechanism (not illustrated) for supplying cleaning liquid to the interior of the caps 42 are provided in the caps 42. Furthermore, a waste liquid tray 44 is provided at a position below the cap 42. The cleaning liquid supplied to the cap 42 is discarded into this waste liquid tray 44 and is recovered into a waste liquid tank 48 from the waste liquid tray 44 via a waste liquid recovery pipe 46.

The nozzle surface cleaning apparatus 80 is constituted by a head cleaning liquid deposition apparatus 81 and a nozzle surface wiping apparatus 83, and is arranged between the paper conveyance mechanism 20 and the maintenance unit 40. The nozzle surface cleaning apparatus 80 deposits cleaning liquid on the nozzle surface 33 of the head 32 from the head cleaning liquid deposition apparatus 81, when the head supporting frame 34 is moved from the image recording position to the maintenance position, and the nozzle surface 33 of the head 32 is wiped by a wiping web on which cleaning liquid has been deposited, by the nozzle surface wiping apparatus 83, thereby cleaning the nozzle surface 33.

<Composition of Nozzle Surface Cleaning Apparatus>

Figure 5:
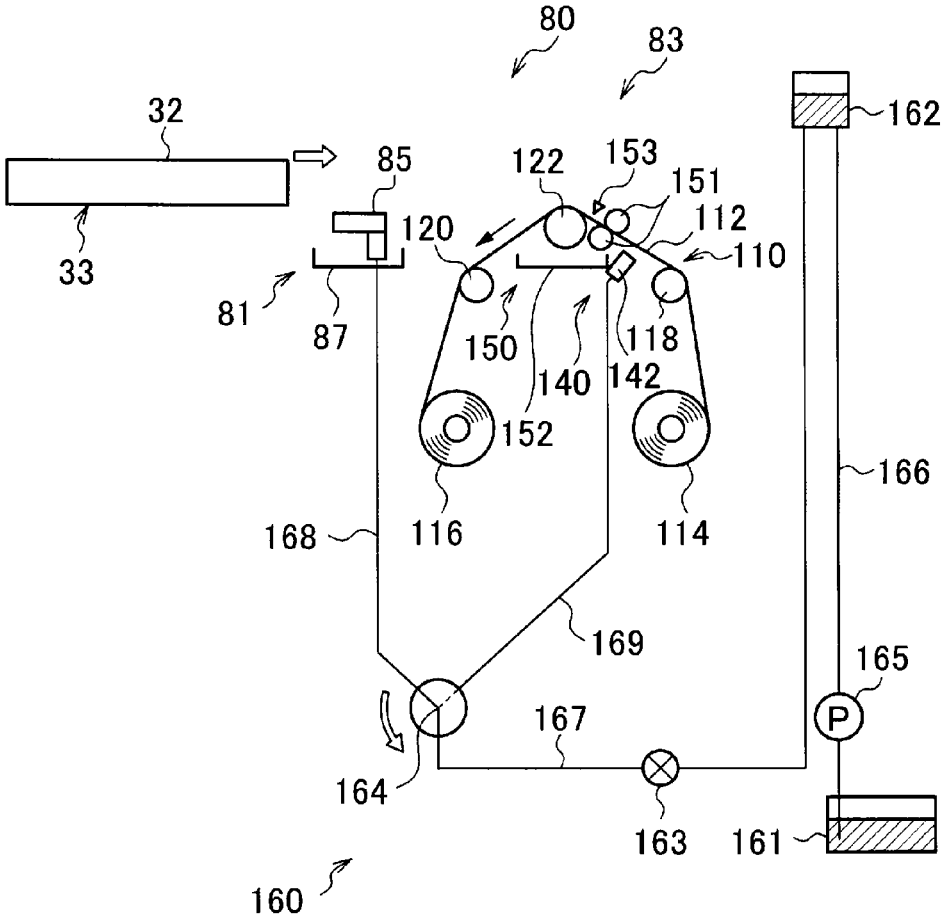
FIG. 5 is a schematic drawing showing an approximate composition of a nozzle surface cleaning apparatus according to a first embodiment.

FIG. 5 is a schematic drawing showing the approximate composition of the nozzle surface cleaning apparatus 80. The nozzle surface cleaning apparatus 80 is constituted by a head cleaning liquid deposition apparatus 81 and a nozzle surface wiping apparatus 83. The head cleaning liquid deposition apparatus 81 includes head cleaning liquid supply nozzles 84C, 84M, 84Y, 84K which deposit cleaning liquid onto the nozzle surfaces 33C, 33M, 33Y, 33K of the heads 32C, 32M, 32Y, 32K, and cleaning liquid holding surfaces 85C, 85M, 85Y, 85K on which cleaning liquid is held. The head cleaning liquid supply nozzles 84C, 84M, 84Y, 84K and the cleaning liquid holding surfaces 85C, 85M, 85Y, 85K are disposed on a cleaning liquid deposition apparatus main body 86, in accordance with the deposition interval of the heads. The head cleaning liquid supply nozzles 84C, 84M, 84Y, 84K and the cleaning liquid holding surfaces 85C, 85M, 85Y, 85K each have the same composition, and therefore the compositions of a head cleaning liquid supply nozzle 84 and a cleaning liquid holding surface 85 are described below.

Cleaning liquid supplied from the head cleaning liquid supply nozzle 84 is held on the cleaning liquid holding surface 85. By moving the head 32 over the cleaning liquid holding surface 85 on which cleaning liquid is held, the cleaning liquid between the cleaning liquid holding surface 85 and the nozzle surface 33 wets and spreads using the lyophobic properties of the nozzle surface 33, and the cleaning liquid can be applied to the nozzle surface 33. Furthermore, the excess cleaning liquid which is not applied to the nozzle surface 33 and which remains on the cleaning liquid holding surface 85 is recovered into a recovery receptacle section 87.

The nozzle surface wiping apparatus 83 is constituted by wiping units 100C, 100M, 100Y, 100K which are installed on a wiping apparatus main body frame 82, and a wiping apparatus main body elevator apparatus (not illustrated) which raises and lower the wiping apparatus main body frame 82.

The wiping units 100C, 100M, 100Y, 100K respectively abut a wiping web formed in a band shape against the nozzle surfaces 33 of the heads 32 while causing the wiping webs (with reference numeral 112 in FIG. 5) to travel, thereby wiping the nozzle surfaces 33. The wiping units 100C, 100M, 100Y, 100K are provided for each respective head and are arranged on the wiping apparatus main body frame 82 in accordance with the installation pitch of the heads 32. The wiping units 100C, 100M, 100Y, 100K all have the same composition and therefore the composition is described here with respect to one wiping unit 100.

The wiping unit 100 which constitutes the nozzle surface wiping apparatus 83 includes a conveyance unit 110 that conveys a wiping web 112 (corresponding to a "wiping member travel device"), a cleaning liquid deposition unit 140 which supplies cleaning liquid to the wiping web 112, and a cleaning liquid recovery unit 150 which recovers excess cleaning liquid from the wiping web 112 to which cleaning liquid has been supplied. Furthermore, the wiping unit 100 also includes a cleaning liquid supply unit 160 which supplies cleaning liquid to the head cleaning liquid deposition apparatus 81 and the nozzle surface wiping apparatus 83.

<Composition of Conveyance Unit>

The conveyance unit 110 includes: a pay out-side web core 114 which pays out a wiping web 112 before wiping; a take up-side web core 116 which takes up a wiping web 112 after wiping, by being driven to rotate by a take up motor (not illustrated); a first guide roller 118 which rotates while abutting against the wiping web 112 paid out from the pay out-side web core 114, and guides the wiping web 112 to the cleaning liquid deposition unit 140 and a pressing roller 122 (corresponding to a "pressing device"); a pressing roller 122 which causes the wiping web 112 to abut against the nozzle surface 33 of the head 32 with a prescribed pressure; and a second guide roller 120 which guides the wiping web 112 after wiping to the take up-side web core 116.

The wiping web 112 is, for example, constituted by a knitted or woven sheet made of ultra-fine fibers of PET, PE, NY, or the like, and is formed in a band shape having a width corresponding to the width of the nozzle surface 33 of the head 32 being wiped. The wiping web 112 is supplied in a state of being wrapped in the form of a roll about a pay out-side web core 114, the front end of the web being fixed to the take up-side core 116.

The first guide roller 118 is supported rotatably on a spindle which is disposed horizontally (not illustrated), and guides the wiping web 112 paid out from the pay out-side web core 114 towards the cleaning liquid deposition unit 140.

The pressing roller 122 is disposed horizontally, one end of the spindle portion thereof being supported in a rotatable fashion. The pressing roller 122 is constituted by a rubber roller corresponding to the width of the wiping web 112, and causes the wiping web 112 to abut against the nozzle surface 33 of the head 32 with a prescribed pressure.

The second guide roller 120 is supported rotatably on a spindle which is disposed horizontally (not illustrated), and guides the wiping web 112 conveyed from the pressing roller 122 towards the take up-side web core 116.

As described above, the wiping web 112 is provided in the form of a roll on the pay out-side web core 114, and can therefore be installed (replaced) on the wiping unit 100 in this state. More specifically, after the pay out-side web core 114 has been installed by fitting onto a pay out spindle, the wiping web 112 is wrapped in order about the first guide roller 118, the pressing roller 122 and the second guide roller 120, and the take up-side web core 116 is fitted onto a take up spindle, thereby completing installation.

<Composition of Cleaning Liquid Deposition Unit>

The cleaning liquid deposition unit 140 is principally constituted by a web cleaning liquid supply nozzle 142 (corresponding to a "wiping member cleaning liquid deposition device"). The web cleaning liquid supply nozzle 142 has a spray port of a width corresponding to the width of the wiping web 112, and sprays cleaning liquid from this spray port. The web cleaning liquid supply nozzle 142 is disposed so as to spray cleaning liquid in an upward direction. Cleaning liquid is sprayed from the spray port and thereby deposited onto the wiping web 112, when the wiping web 112 passes over this web cleaning liquid supply nozzle 142. Consequently, cleaning liquid is absorbed inside the wiping web 112.

<Composition of Cleaning Liquid Recovery Unit>

The cleaning liquid recovery unit 150 is principally constituted by a squeeze roller pair 151 (corresponding to a "squeezing device"), a recovery receptacle member 152, and a moisture meter 153.

The squeeze roller pair 151 is a pressurizing device which is constituted by two mutually opposing rollers. The squeeze rollers have a width corresponding to the width of the wiping web 112, and are made from a rubber, such as silicone or EPDM, or a metal such as stainless steel, which is not destroyed by the cleaning liquid.

The squeeze roller pair 151 is disposed in the conveyance path of the wiping web 112 and to the downstream side of the web cleaning liquid supply nozzle 142. The squeeze roller pair 151 sandwiches and presses the wiping web 112 on which the cleaning liquid has been deposited, and squeezes out the cleaning liquid from the wiping web 112. By this means, excess cleaning liquid is recovered from the wiping web 112, and the wiping web 112 is wetted with a suitable amount of cleaning liquid.

A moisture meter 153, which is a measurement device for measuring the amount of cleaning liquid in the wiping web 112, is arranged to the downstream side of the squeeze roller pair 151. The amount of cleaning liquid in the wiping web 112 is measured by the moisture meter 153. By controlling a pressure adjustment mechanism (not illustrated) of the squeeze rollers in accordance with the amount of cleaning liquid measured by this moisture meter 153, it is possible to control the amount of cleaning liquid in the wiping web 112 after recovery of cleaning liquid, to a suitable amount.

Furthermore, a recovery receptacle member 152 which recovers the squeezed cleaning liquid is provided below the squeeze roller pair 151. The cleaning liquid recovered into the recovery receptacle member 152 is sent to a main tank 161 for reuse, after passing through a filter (not illustrated) to remove impurities.

In this way, the wiping web 112 which has been wetted by a suitable amount of cleaning liquid is abutted and pressed against the nozzle surface 33 by the pressing roller 122, and the nozzle surface 33 is wiped successively by an unused region of the wiping web 112.

<Composition of Cleaning Liquid Supply Unit>

The cleaning liquid supply unit 160 includes a main tank 161 which stores cleaning liquid, a reserve tank 162 which temporarily stores cleaning liquid, a control valve 163 which controls a flow rate, and a flow channel switching valve 164 which switches the supply destination of the cleaning liquid.

The main tank 161 is connected to the reserve tank 162 via a flow channel 166. The cleaning liquid in the main tank 161 is conveyed along the flow channel 166 by a pump 165 which is provided at an intermediate point of the flow channel 166. The reserve tank 162 is connected to the flow channel switching valve 164 via a flow channel 167. A control valve 163 is provided in the flow channel 167 and controls a flow rate of cleaning liquid from the reserve tank 162. The reserve tank 162 is desirably provided at a position higher than the nozzle surface cleaning apparatus 80, in such a manner that cleaning liquid can be supplied to the nozzle surface cleaning apparatus 80 using a liquid head differential. By supplying cleaning liquid using a liquid head differential, it is possible to supply cleaning liquid without being affected by a pulsating action of the pump, and therefore non-uniformities in the deposition of cleaning liquid can be prevented.

The flow channel switching valve 164 is connected to a head cleaning liquid flow channel 168 (which corresponds to a "first flow channel") and a web cleaning liquid flow channel 169 (which corresponds to a "second flow channel"). The head cleaning liquid flow channel 168 is connected to the head cleaning liquid supply nozzle 84 and the web cleaning liquid flow channel 169 is connected to the web cleaning liquid supply nozzle 142. By means of the flow channel switching valve 164, a composition is achieved in which the flow channel 167 can be connected to either the head cleaning liquid flow channel 168 or the web cleaning liquid flow channel 169, and the supply of the cleaning liquid to the head cleaning liquid supply nozzle 84 or the web cleaning liquid supply nozzle 142 can be switched by switching this flow channel switching valve 164.

Here, the main tank 161 and the reserve tank 162 are provided for each head cleaning liquid supply nozzle 84 and each wiping unit 100, but it is also possible to adopt a composition in which one main tank 161, one pump 165 and one reserve tank 162 are used commonly for each of the head cleaning liquid supply nozzles 84C, 84M, 84Y, 84K, and each of the wiping units 100C, 100M, 100Y, 100K. In this case, cleaning liquid is supplied from the one reserve tank 162, via the flow channels 167C, 167M, 167Y, 167K and three-way valves 164C, 164M, 164Y, 164K to the head cleaning liquid supply nozzles 84C, 84M, 84Y, 84K or the web cleaning liquid supply nozzles 142C, 142M, 142Y, 142K, and then sprayed from the respective nozzles.

<Action of Nozzle Surface Cleaning Apparatus>

Next, the action of the nozzle surface cleaning apparatus 80 which is composed as described above will be explained. The nozzle surface cleaning apparatus 80 wipes the nozzle surface 33 during the course of the movement of the head 32 from an image recording position to a maintenance position.

The head cleaning liquid deposition apparatus 81 and the nozzle surface wiping apparatus 83 which constitute the nozzle surface cleaning apparatus 80 are composed so as to be raisable and lowerable in their entirety, by an elevator mechanism. The head cleaning liquid deposition apparatus 81 and the nozzle surface wiping apparatus 83 are situated at a prescribed standby position when cleaning is not being performed, and during cleaning, are situated at a prescribed operating position which is raised by a prescribed amount with respect to the standby position.

In a state where the head cleaning liquid deposition apparatus 81 is situated in the operating position, it is possible to deposit cleaning liquid onto the nozzle surfaces 33 of the heads 32 by the cleaning liquid which is held on the cleaning liquid holding surfaces 85. In other words, when the heads 32 pass the head cleaning liquid deposition apparatus 81, cleaning liquid can be applied to the nozzle surfaces due to the nozzle surfaces coming into contact with the cleaning liquid held on the cleaning liquid holding surfaces 85. Furthermore, when the nozzle surface wiping apparatus 83 is situated in the operating position, it is possible to wipe the nozzle surfaces 33 with the wiping units 100. In other words, when each of the heads 32 passes the respective wiping units 100, a wiping web 112 which is wrapped about the pressing roller 122 can be abutted and pressed against the nozzle surfaces 33 of the heads 32.

When the head enters into nozzle surface cleaning mode, the heads 32 are moved from an image recording position to a maintenance position, by a head movement device (not illustrated). When the heads 32 reach a prescribed position, the wiping webs 112 are conveyed in an opposite direction to the direction of travel of the heads 32 by the conveyance unit 110. In other words, driving of the take up motor is started, whereby the wiping webs 112 are each paid out from the pay out-side web core 114 and travel so as to be taken up on the take up-side web core 116.

In this case, a friction is applied to the pay out spindle of the pay out-side web core 114 by a friction mechanism, and the take up spindle of the take up-side web core 116 slides when a prescribed load or greater is applied by a torque limiter, thereby making it possible to apply a prescribed tension to the wiping web 112 while the web travels.

Simultaneously with the start of conveyance of the wiping web 112, the control valve 163 and the flow channel switching valve 164 are controlled and cleaning liquid is ejected from the web cleaning liquid supply nozzle 142 to wet the wiping web 112. The web cleaning liquid supply nozzle 142 upwardly sprays cleaning liquid conveyed from the reserve tank 162 due to the liquid head differential. This sprayed cleaning liquid is deposited onto the wiping web 112, when the wiping web 112 passes over the web cleaning liquid supply nozzle 142. Consequently, cleaning liquid is absorbed inside the wiping web 112. In this case, cleaning liquid of a prescribed amount which is greater than the amount of cleaning liquid suitable for wiping and cleaning the nozzle surface 33 is deposited on the wiping web 112. For example, cleaning liquid of an amount which saturates the absorption capability of the wiping web 112 is deposited.

The excessively deposited cleaning liquid in the wiping web 112 is squeezed out from the wiping web 112 by the squeeze roller pair 151, thereby adjusting the amount of cleaning liquid deposited in the wiping web 112. Consequently, the excessive cleaning liquid is recovered from the wiping web 112, and the wiping web 112 assumes a state of being wetted by a suitable amount of cleaning liquid (an amount suitable for wiping the nozzle surface 33 and for wiping away cleaning liquid which has been deposited by the head cleaning liquid deposition apparatus 81). In this way, by recovering excessive cleaning liquid and wetting the wiping web 112 with a suitable amount of cleaning liquid, it is possible to suppress the drawing out of ink from the nozzles N during wiping of the nozzle surface 33. In the foregoing description, a composition is explained in which an amount of cleaning liquid greater than an amount of cleaning liquid suited for wiping and cleaning is deposited and cleaning liquid is recovered by the squeeze roller pair 151, but it is also possible to deposit an amount of cleaning liquid which is suited to wiping and cleaning from the web cleaning liquid supply nozzle 142.

The amount of cleaning liquid in the wiping web 112 from which cleaning liquid has been recovered by the squeeze roller pair 151 is measured by the moisture meter 153. By controlling a pressure of the squeeze roller pair 151 in accordance with this measured amount of cleaning liquid, it is possible to control the amount of cleaning liquid in the wiping web 112 after cleaning liquid recovery by the squeezing roller pair 151, to a suitable amount. By using feedback control in this way, it is possible to control the amount of lubrication of the wiping web 112 with even greater accuracy.

After the head 32 has been moved to a position directly in front of the head cleaning liquid deposition apparatus 81, the flow channel switching valve 164 is controlled so as to eject cleaning liquid from the head cleaning liquid supply nozzle 84, and the cleaning liquid is held on the cleaning liquid holding surface 85. Due the nozzle surface 33 of the head passing over the cleaning liquid holding surface 85 on which cleaning liquid is held, the cleaning liquid layer formed between the nozzle surface 33 and the cleaning liquid holding surface 85 makes contact with the nozzle surface 33 and cleaning liquid is thereby applied to the nozzle surface 33.

The nozzle surface 33 onto which cleaning liquid has been applied is wiped by the wetted wiping web 112 of the nozzle surface wiping apparatus 83. The wiping web 112 is abutted and pressed while applying a suitable pressure against the nozzle surface 33 by the pressing roller 122, while travelling due to the driving of the take up motor, whereby the nozzle surface 33 is wiped and cleaned.

During this, the wiping web 112 wipes the nozzle surface 33 while traveling in the opposite direction to the direction of movement of the nozzle surface 33. By this means, the nozzle surface 33 can be wiped efficiently. Furthermore, it is also possible to perform wiping of the nozzle surface 33, by using a new surface (unused region) of the wiping web 112 at all times.

The wiping web 112 which has wiped the nozzle surface 33 is taken up onto the take up-side web core 116. Furthermore, the head 32 is moved to the maintenance position and the nozzle surface 33 is covered with a cap 42.

In this way, dirt on the nozzle surface 33 is softened by the cleaning liquid which has been applied from the head cleaning liquid deposition apparatus 81, and therefore the dirt can subsequently be removed easily by the wiping of the wiping web 112 of the nozzle surface wiping apparatus 83. Therefore, it is possible to reduce the pressure applied to the nozzle surface 33 by the pressing roller 122, and hence the damage caused to the lyophobic treatment on the nozzle surface 33 can be minimized.

Furthermore, unwanted cleaning liquid remaining on the nozzle surface, of the cleaning liquid which has been applied by the head cleaning liquid deposition apparatus 81, is wiped away by the wiping web 112 of the nozzle surface wiping apparatus 83. The wiping web 112 is wetted suitably by the cleaning liquid, in other words, wetted to an extent which allows excess cleaning liquid remaining on the nozzle surface 33 to be absorbed, and therefore it is possible to prevent ink from being drawn out from the nozzles N and soiling the nozzle surface 33. Consequently, there is no solidification of ink which has been drawn out and this solidified material is not pushed inside the head 32 during the subsequent wiping action, and therefore the ejection characteristics can be improved.

In the embodiment described above, it is necessary to wet the wiping web 112 through a length required for wiping the length of the nozzle surface 33 in the conveyance direction, until the head 32 passes over the head cleaning liquid deposition apparatus 81, and therefore the length from the pressing roller 122 to the web cleaning liquid supply nozzle 142 must be the same as the length of the wiping web 112 required to wipe the nozzle surface 33. Consequently, it is necessary to control the movement speed of the head 32, the conveyance speed of the wiping web 112, the distance between the pressing roller 122 and the web cleaning liquid supply nozzle 142, and the distance between the head cleaning liquid supply nozzle 84 and the pressing roller 122, and the like. In particular, if the conveyance speed of the wiping web 112 is slow, then it is necessary to lengthen the distance between the pressing roller 122 and the web cleaning liquid supply nozzle 142, and hence there have been major restrictions on the layout of the apparatus.

Therefore, by providing a mechanism for controlling fast-forwarding and rewinding of the wiping web 112, in the conveyance unit 110, it is possible to reduce the size of the layout of the nozzle surface wiping apparatus 83. More specifically, firstly, cleaning liquid is deposited by the web cleaning liquid supply nozzle 142 so as to wet the wiping web 112 through a length necessary to wipe the length of the nozzle surface 33 in the conveyance direction. Thereupon, the wiping web 112 is rewound in such a manner that the leading position, in the conveyance direction, of the portion of the wiping web 112 on which cleaning liquid has been deposited becomes the portion which contacts the nozzle surface 33 on the pressing roller 122.

Thereupon, the flow channel is switched by the flow channel switching valve 164, in accordance with the movement of the head 32, and cleaning liquid is supplied to the head cleaning liquid supply nozzle 84, thereby applying cleaning liquid to the nozzle surface 33. When the head 32 has reached the pressing roller 122 of the nozzle surface wiping apparatus 83, the conveyance of the wiping web 112 is started again, whereby the nozzle surface 33 can be cleaned and excess cleaning liquid can be wiped away.

By adopting a composition of this kind, it is possible to shorten the distance between the head cleaning liquid supply nozzle 84 and the pressing roller 122, and to shorten the distance between the pressing roller 122 and the web cleaning liquid supply nozzle 142, and therefore the nozzle surface cleaning apparatus 80 can be made more compact in size. Furthermore, it is also possible to prevent dripping of liquid before the cleaning liquid deposited on the nozzle surface 33 by the head cleaning liquid deposition apparatus 81 is wiped by the nozzle surface wiping apparatus 83.

[Modification Examples]

Figure 6:
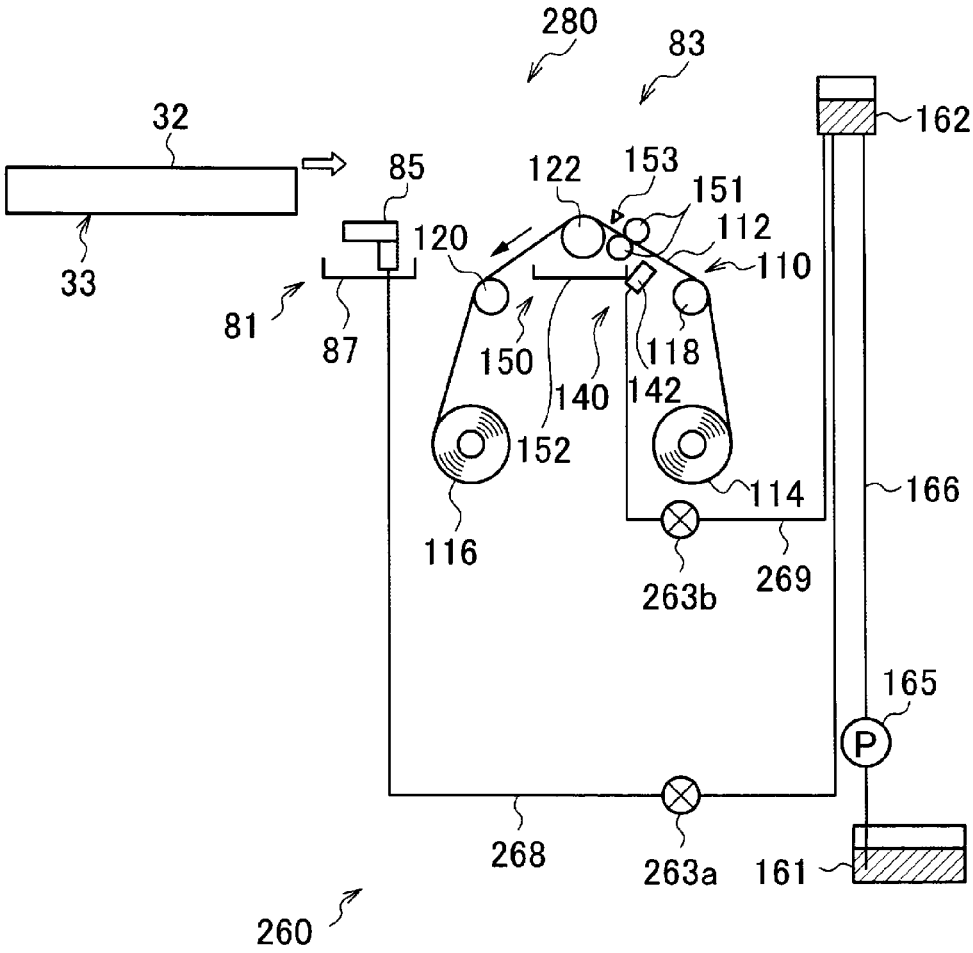
FIG. 6 is a schematic drawing showing an approximate composition of a nozzle surface cleaning apparatus according to a modification of the first embodiment.

FIG. 6 is a schematic drawing showing an approximate composition of a modification of a nozzle surface cleaning apparatus 280 relating to a first embodiment of the invention. The nozzle surface cleaning apparatus 280 shown in FIG. 6 supplies cleaning liquid to the head cleaning liquid supply nozzle 84 from the reserve tank 162 via a head cleaning liquid flow channel 268 and a control valve 263*a*. Furthermore, the web cleaning liquid supply nozzle 142 is connected to the web cleaning liquid supply nozzle 142 via a web cleaning liquid flow channel 269 and a control valve 263*b*. In this way, the nozzle surface cleaning apparatus 280 shown in FIG. 6 differs from the nozzle surface cleaning apparatus 80 shown in FIG. 5 in that cleaning liquid is supplied to the head cleaning liquid supply nozzle 84 and to the web cleaning liquid supply nozzle 142 by respective flow channels from the reserve tank 162.

As shown in FIG. 6, by supplying cleaning liquid from the reserve tank 162 via the respective flow channels, it is possible to supply cleaning liquid independently to the head cleaning liquid supply nozzle 84 and the web cleaning liquid supply nozzle 142. Consequently, cleaning liquid can be ejected simultaneously from the head cleaning liquid supply nozzle 84 and the web cleaning liquid supply nozzle 142, and therefore the restrictions on the layout of the nozzle surface cleaning apparatus are reduced and hence the size of the apparatus can be made more compact.

(Second Embodiment)

Figure 7:
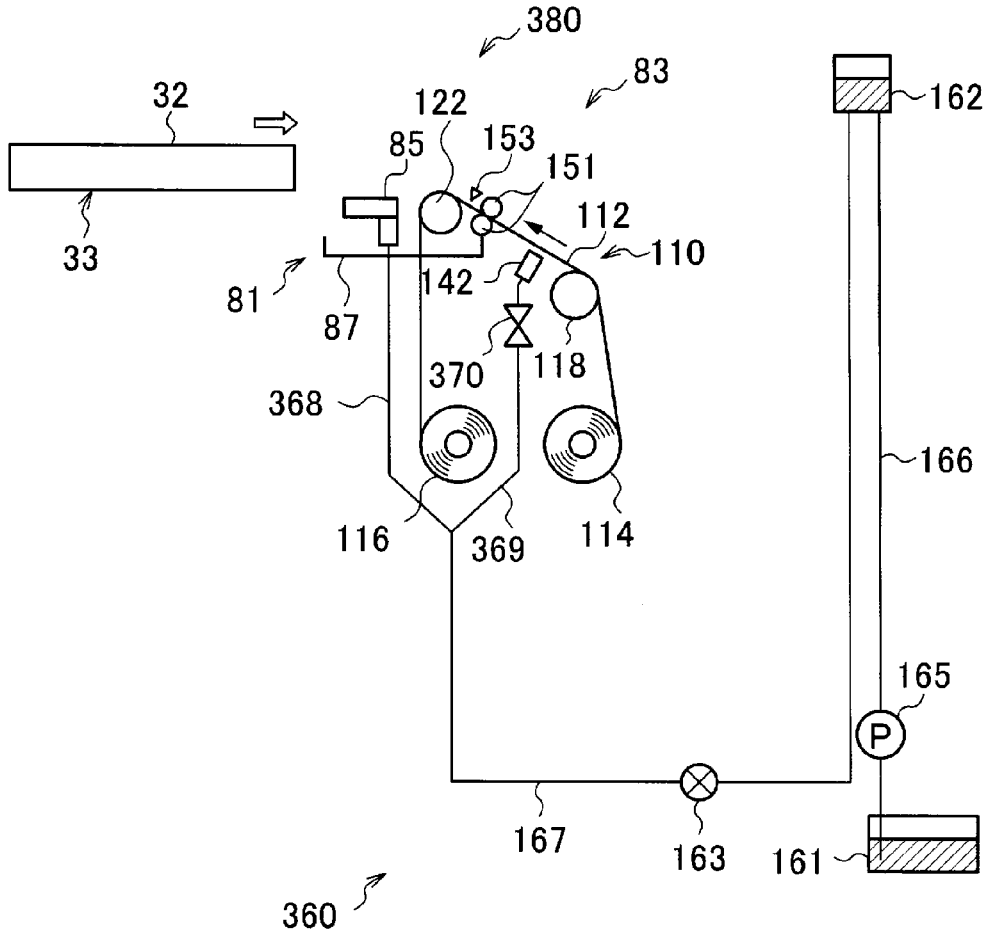
FIG. 7 is a schematic drawing showing an approximate composition of a nozzle surface cleaning apparatus according to a second embodiment.

FIG. 7 is a schematic drawing showing a schematic composition of a nozzle surface cleaning apparatus 380 relating to a second embodiment of the invention. The nozzle surface cleaning apparatus 380 relating to the second embodiment differs from the nozzle surface cleaning apparatus relating to the first embodiment in that a flow channel resistance 370 is provided in the web cleaning liquid flow channel 369, instead of the flow channel switching valve.

By providing a flow channel resistance 370 in the web cleaning liquid flow channel 369, it is possible to deposit cleaning liquid simultaneously while altering the flow rate of the cleaning liquid from the head cleaning liquid supply nozzle 84 and the web cleaning liquid supply nozzle 142. The flow channel resistance 370 is provided in such a manner that the flow rate of cleaning liquid in the web cleaning liquid flow channel 369 is lower than the flow rate in the head cleaning liquid flow channel 368. By adopting a composition of this kind, the restrictions on the layout of the nozzle surface cleaning apparatus are reduced, and therefore the apparatus can be made more compact in size. By adopting a composition of this kind, there is no need to provide a fast-forward and rewind mechanism, and the apparatus can be made compact in size.

For the flow channel resistance 370, it is possible to use a narrow-diameter tube or a filter, or the like. Furthermore, it is also possible to create a resistance in the flow channel and to reduce the flow rate by pinching a tube using a valve or cam.

More specifically, in order to eject a liquid flow of 45 ml/min from the head cleaning liquid supply nozzle 84 and 5 ml/min from the web cleaning liquid supply nozzle 142, it is possible to use a flow resistance of 0.5 diameter by 50 mm length. The normal flow channel size is a flow channel of 4 mm diameter (internal diameter) by 6 mm diameter (outer diameter). In this case, by setting the head movement speed to 20 mm/sec and setting the wiping web conveyance speed to 3.2 mm/sec, it is possible to achieve a nozzle surface which is clean and on which there is no drawing out of the ink after wiping.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A nozzle surface cleaning apparatus which cleans a nozzle surface of a droplet ejection head, comprising:

a nozzle surface cleaning liquid deposition device which deposits cleaning liquid onto the nozzle surface of the droplet ejection head;

a wiping member travel device which causes a wiping member having absorbing characteristics to travel;

a wiping member cleaning liquid deposition device which deposits cleaning liquid onto the wiping member;

a pressing device which presses and abuts the wiping member on which the cleaning liquid has been deposited, against the nozzle surface on which the cleaning liquid has been deposited by the nozzle surface cleaning liquid deposition device, and wipes the nozzle surface with the wiping member;

a first flow channel for supplying the cleaning liquid to the nozzle surface cleaning liquid deposition device;

a second flow channel for supplying the cleaning liquid to the wiping member cleaning liquid deposition device; and a common flow channel for supplying the cleaning liquid to the first flow channel and the second flow channel, the second flow channel being provided with a flow channel resistance member.

2. The nozzle surface cleaning apparatus as defined in claim 1, further comprising:

a first flow channel for supplying the cleaning liquid to the nozzle surface cleaning liquid deposition device;

a second flow channel for supplying the cleaning liquid to the wiping member cleaning liquid deposition device;

a common flow channel for supplying the cleaning liquid to the first flow channel and the second flow channel; and a switching device which can switch the cleaning liquid supplied from the common flow channel, to the first flow channel or the second flow channel.

3. The nozzle surface cleaning apparatus as defined in claim 2, wherein the switching device switches from the second flow channel to the first flow channel, when the nozzle surface of the droplet ejection head reaches a position of the nozzle surface cleaning liquid deposition device.

4. The nozzle surface cleaning apparatus as defined in claim 1, wherein the wiping member travel device includes a rewind and fast-forward device for rewinding and fast-forwarding the wiping member.

5. The nozzle surface cleaning apparatus as defined in claim 2, wherein the wiping member travel device includes a rewind and fast-forward device for rewinding and fast-forwarding the wiping member.

6. The nozzle surface cleaning apparatus as defined in claim 3, wherein the wiping member travel device includes a rewind and fast-forward device for rewinding and fast-forwarding the wiping member.

7. The nozzle surface cleaning apparatus as defined in claim 1, further comprising: a squeezing device which removes excess cleaning liquid from the wiping member on which the cleaning liquid has been deposited.

8. The nozzle surface cleaning apparatus as defined in claim 2, further comprising: a squeezing device which removes excess cleaning liquid from the wiping member on which the cleaning liquid has been deposited.

9. The nozzle surface cleaning apparatus as defined in claim 3, further comprising: a squeezing device which removes excess cleaning liquid from the wiping member on which the cleaning liquid has been deposited.

10. The nozzle surface cleaning apparatus as defined in claim 4, further comprising: a squeezing device which removes excess cleaning liquid from the wiping member on which the cleaning liquid has been deposited.

11. The nozzle surface cleaning apparatus as defined in claim 1, further comprising: a squeezing device which removes excess cleaning liquid from the wiping member on which the cleaning liquid has been deposited.

12. The nozzle surface cleaning apparatus as defined in claim 1, further comprising a tank which stores cleaning liquid, wherein the tank is provided above the nozzle surface cleaning liquid deposition device and the wiping member cleaning liquid deposition device, in a vertical direction, and supply of the cleaning liquid to the nozzle surface cleaning liquid deposition device and the wiping member cleaning liquid deposition device is performed by a liquid head differential.

13. The nozzle surface cleaning apparatus as defined in claim 2, further comprising a tank which stores cleaning liquid, wherein the tank is provided above the nozzle surface cleaning liquid deposition device and the wiping member cleaning liquid deposition device, in a vertical direction, and supply of the cleaning liquid to the nozzle surface cleaning liquid deposition device and the wiping member cleaning liquid deposition device is performed by a liquid head differential.

14. The nozzle surface cleaning apparatus as defined in claim 3, further comprising a tank which stores cleaning liquid, wherein the tank is provided above the nozzle surface cleaning liquid deposition device and the wiping member cleaning liquid deposition device, in a vertical direction, and supply of the cleaning liquid to the nozzle surface cleaning liquid deposition device and the wiping member cleaning liquid deposition device is performed by a liquid head differential.

15. The nozzle surface cleaning apparatus as defined in claim 4, further comprising a tank which stores cleaning liquid, wherein the tank is provided above the nozzle surface cleaning liquid deposition device and the wiping member cleaning liquid deposition device, in a vertical direction, and supply of the cleaning liquid to the nozzle surface cleaning liquid deposition device and the wiping member cleaning liquid deposition device is performed by a liquid head differential.

16. The nozzle surface cleaning apparatus as defined in claim 1, further comprising a tank which stores cleaning liquid, wherein the tank is provided above the nozzle surface cleaning liquid deposition device and the wiping member cleaning liquid deposition device, in a vertical direction, and supply of the cleaning liquid to the nozzle surface cleaning liquid deposition device and the wiping member cleaning liquid deposition device is performed by a liquid head differential.

17. The nozzle surface cleaning apparatus as defined in claim 7, further comprising a tank which stores cleaning liquid, wherein the tank is provided above the nozzle surface cleaning liquid deposition device and the wiping member cleaning liquid deposition device, in a vertical direction, and supply of the cleaning liquid to the nozzle surface cleaning liquid deposition device and the wiping member cleaning liquid deposition device is performed by a liquid head differential.

18. An image recording apparatus, comprising:

a conveyance device which conveys a recording medium;

a droplet ejection head which records an image by ejecting liquid droplets onto the recording medium which is conveyed by the conveyance device; and the nozzle surface cleaning apparatus as defined in claim 1 which cleans the nozzle surface of the droplet ejection head.

19. The image recording apparatus as defined in claim 18, wherein the droplet ejection head is provided in plurality in a conveyance path of the recording medium, and the nozzle surface cleaning apparatus is provided for each of the droplet ejection heads.

* * * * *